US005500335A

United States Patent [19]

Bell

[11] Patent Number: 5,500,335

[45] Date of Patent: Mar. 19, 1996

[54] PHOTOGRAPHIC EMULSION CONTAINING TRANSITION METAL COMPLEXES

[75] Inventor: Eric L. Bell, Webster, N.Y.

[73] Assignee: Eastman Kodak Company, Rochester, N.Y.

[21] Appl. No.: 331,832

[22] Filed: Oct. 31, 1994

[51] Int. Cl.[6] ..... G03C 1/09

[52] U.S. Cl. ..... 430/567; 430/604; 430/605; 430/612

[58] Field of Search ..... 430/604, 605, 430/612, 567

[56] References Cited

U.S. PATENT DOCUMENTS

| | | | |
|---|---|---|---|
| 3,672,901 | 6/1972 | Ohkubo et al. | 430/569 |
| 3,901,713 | 8/1975 | Yamasue et al. | 430/564 |
| 4,147,542 | 4/1979 | Habu et al. | 430/346 |
| 4,828,962 | 5/1989 | Grzeskowiak et al. | 430/230 |
| 4,835,093 | 5/1989 | Janusonis et al. | 430/567 |
| 4,933,272 | 6/1990 | McDugle et al. | 430/567 |
| 4,937,180 | 6/1990 | Marchetti et al. | 430/567 |
| 4,945,035 | 7/1990 | Keevert, Jr. et al. | 430/567 |
| 5,166,044 | 11/1992 | Asami | 430/567 |
| 5,252,451 | 10/1993 | Bell | 430/567 |
| 5,256,530 | 10/1993 | Bell | 430/567 |
| 5,360,712 | 11/1994 | Olm et al. | 430/567 |
| 5,372,926 | 12/1994 | Beavers et al. | 430/605 |
| 5,385,817 | 1/1995 | Bell | 430/567 |

FOREIGN PATENT DOCUMENTS

| | | |
|---|---|---|
| 0325235 | 7/1989 | European Pat. Off. . |
| 0457298 | 11/1991 | European Pat. Off. . |
| 92/16876 | 1/1992 | WIPO . |

*Primary Examiner*—Charles L. Bowers, Jr.
*Assistant Examiner*—Mark F. Huff
*Attorney, Agent, or Firm*—Peter C. Cody

[57] ABSTRACT

The present invention provides a photographic emulsion comprising comprising silver halide grains, an iridium containing hexacoordination complex, and at least two grain surface modifiers, wherein the first of the grain surface modifiers is a transition metal complex comprising a nitrosyl or thionitrosyl ligand with a transition metal selected from the Groups 5 to 10, inclusive, of the periodic table, and the second of the grain surface modifiers is a transition metal complex comprising a transition metal, other than iridium, which is selected from Groups 7 to 10, inclusive, of the periodic table.

23 Claims, No Drawings

PHOTOGRAPHIC EMULSION CONTAINING TRANSITION METAL COMPLEXES

FIELD OF THE INVENTION

This invention relates to photographic emulsions. In particular, it relates to photographic silver halide emulsions containing a combination of transition metal complexes.

BACKGROUND OF THE INVENTION

Images that exhibit high contrast are highly desired in the photographic industry because such images appear sharp to the viewer. The industry has thus sought to ways to increase the contrast of the images formed in its products.

Contrast has typically been measured by one of two parameters: the gamma (γ) of the emulsion layers contained in a product, and the sharpness of the toe section of the emulsion layers' D-log E curves. By gamma, it is usually meant the slope of the straight-line section of the D-log E curve of a given emulsion layer, typically determined at the speed point. By sharpness of the toe section, it is usually meant the relative density of the toe section. For instance, a sharp toe corresponds to a relatively low (small) toe density, and a soft toe corresponds to a relatively high (large) toe density. Generally, the point at which toe density is measured corresponds to 0.3 log E fast of the speed point (typically the point on the D-log E curve where density equals 1.0), although toe density may properly be measured at any point prior to the curve's primary increase in slope.

If either the value of gamma is high or the toe is sharp, then the image has a relatively high contrast. If the value of is low or the toe is soft, the image has a relatively low contrast.

In an effort to improve the contrast and other photographic properties of photographic elements based on silver halide emulsions, the photographic industry has incorporated various compounds into photographic elements. These compounds are of two general types: dopants and grain surface modifiers. Dopants are substances added to an emulsion during silver halide precipitation which become incorporated within the internal structure of the silver halide grains. Because they are internally incorporated, they are distinguished from substances added post-precipitation such as chemical or spectral sensitizers. These latter compounds are externally associated with the surface of the silver halide grains and are thus more properly referred to as addenda or grain surface modifiers.

Depending on the level and location of dopants, they may modify the photographic properties of the grains. When the dopants are transition metals which form a part of a coordination complex, such as a hexacoordination complex or a tetracoordination complex, the ligands can also be occluded within the grains, and they too may modify the grain's photographic properties.

Specific examples of doped silver halide emulsions can be found in U.S. Pat. No. 4,147,542, which discloses the use of iron complexes having cyanide ligands; U.S. Pat. Nos. 4,945,035 and 4,937,180 which disclose the use of hexacoordination complexes of rhenium, ruthenium and osmium with at least four cyanide ligands; and U.S. Pat. No. 4,828,962, which discloses the use of ruthenium and iridium ions to reduce high intensity reciprocity failure (HIRF).

Recently, dopants have been described which comprise transition metal complexes having nitrosyl or thionitrosyl ligands. European Patent Applications 0325235 and 0457298 disclose the use of one such complex, namely potassium ferric pentacyanonitrosyl. A second type of dopant, rhenium nitrosyl or rhenium thionitrosyl is disclosed in U.S. Pat. No. 4,835,093; and a third, dicesium pentachloronitrosyl osmate, is disclosed in U.S. Pat. No. 4,933,272.

It has also been known to use combinations of dopants in silver halide emulsions. Such combinations of dopants can be found in U.S. Pat. No. 3,901,713, which discloses the addition of both rhodium and iridium compounds during emulsification or the first ripening; U.S. Pat. No. 3,672,901, which teaches the combined use of iron compounds and iridium or rhodium salts.

Methods of improving the photographic characteristics of silver halide emulsions have also consisted of adding transition metals to the emulsions during chemical or spectral sensitization. As mentioned, transition metals added in this manner, because they are added subsequent to silver halide precipitation, are referred to as grain surface modifiers rather than dopants.

The most prevalent chemical sensitizers are the gold and sulfur sensitizers. Other chemical sensitizers are platinum and iridium salts, and complexes of rhodium, osmium, and ruthenium.

Combinations of grain surface modifiers and dopants, or of two grain surface modifiers, have been utilized and are disclosed in, for example, U.S. Pat. Nos. 5,252,451 and 5,256,530.

Although it is known to employ transition metals, and combinations thereof, as either dopants or grain surface modifiers, prior applications of such transition metals have yielded emulsions exhibiting inferior contrast improvement. This has often been the result of one dopant or grain surface modifier exerting an insufficient effect; or the result of a combination of dopants or grain surface modifiers exerting opposing effects.

Accordingly, it would be desirable to overcome these deficiencies by providing a high contrast silver halide emulsion exhibiting a high gamma and/or sharpened toe, wherein a combination of transition metal complexes imparts the high contrast characteristic.

SUMMARY OF THE INVENTION

The present invention provides a photographic silver halide emulsion comprising silver halide grains, an iridium containing hexacoordination complex, and at least two grain surface modifiers, wherein the first of the grain surface modifiers is a transition metal complex comprising a nitrosyl or thionitrosyl ligand with a transition metal selected from the Groups 5 to 10, inclusive, of the periodic table, and the second of the grain surface modifiers is a transition metal complex comprising a transition metal, other than iridium, which is selected from Groups 7 to 10, inclusive, of the periodic table.

The grain surface modifiers utilized in accordance with the present invention are further characterized in that they are added to the emulsion after silver halide precipitation. Thus, they are adsorbed to the surfaces of the crystal grains, rather than incorporated internally within them; and they, in combination with the iridium containing hexacoordination complex, improve the contrast of the silver halide emulsion beyond that thought previously possible.

DETAILED DESCRIPTION OF THE INVENTION

In the description of the present invention, reference is made to certain groups of the periodic table. The periodic table defining these groups is that adopted by the American Chemical Society and published in the *Chemical and Engineering News*, Feb. 4, 1985, p.26.

Components of silver halide emulsions are often distinguished by whether they are internally or externally associated with the silver halide crystal grains. Compounds which are added during silver halide precipitation, as mentioned previously, are internally incorporated within the crystal structure, and are thus termed dopants. By contrast, compounds added after precipitation become associated with the external surfaces of the grains. A variety of terms is used to define these compounds, including addenda and grain surface modifiers.

The present invention concerns such grain surface modifiers and their ability to be used in combination with a hexacoordination complex comprising iridium to improve emulsion contrast and sensitivity. The grain surface modifiers are added to the silver halide emulsions during the finishing step. Finishing relates to any procedure performed subsequent to silver halide precipitation whereby substances are added to the emulsion in order to modify the surfaces of the silver halide grains. It therefore includes such procedures as chemical sensitization and spectral sensitization.

Finishing may also include a procedure wherein the grain surface modifiers are positioned at intervals along the surface of the silver halide grains in a silver halide carrier. The silver halide carrier, in such instances, accounts for less than about two, and preferably less than about one, mole percent of the crystals' total silver halide content.

Finishing in this manner is preferably performed by means of Lippmann halide carriers—e.g., Lippmann bromide, chloride, bromochloride, chlorobromide, or iodochlorobromide or iodobromochloride wherein iodide content is less than about 10 mole percent. Specifically, a Lippmann halide emulsion (which is a very fine grain silver halide emulsion having average grain sizes around 0.05 microns) will have incorporated in its grains certain levels of grain surface modifiers. The grains of the Lippmann halide emulsion are digested in the presence of the much larger silver halide grains of the present invention. They are then allowed to recrystalize on the surface of the larger grains, thus delivering the grain surface modifiers.

Because the Lippmann halide carriers account for less than about two, and preferably less than about one, mole percent of the total silver halide in the grains, they do not form a shell around the larger grains. Rather, they form deposits at intervals along the surface of the grains. Generally, these deposits will form at the corners of the silver halide grains.

It is also possible to form the emulsions of the present invention by adding the grain surface modifiers alone to a post-precipitation emulsion or with a solution of alkali halide. However, it is preferred to apply the grain surface modifiers by means of Lippmann halide carriers which will bind to the surface of the much larger silver halide grains. If Lippmann halide carriers are not used, and the silver halide grains are predominately silver chloride, it is preferred to apply the grain surface modifiers along with a solution of potassium halide (typically bromide or chloride). As small amounts of the halide displace chloride molecules on the surface of the silver chloride grain, the grain surface modifiers will tend to be adsorbed into the grain surfaces.

The first of the grain surface modifiers suitable for use in the present invention is a transition metal complex. It may be generically defined by the formula:

$$[TE_4(NZ)E']r$$

where

T is a transition metal selected from Groups 5 to 10, inclusive, of the periodic table;

Z is oxygen or sulfur, and together with nitrogen forms the nitrosyl or thionitrosyl ligand;

E and E' represent ligands additional to the nitrosyl or thionitrosyl ligand; and r is 0, −1, −2, or −3.

Preferably the transition metal is selected from Group 8 of the periodic table. Optimally it is selected from either osmium or ruthenium.

Specific examples of preferred ligands represented by E include aquo ligands, halide ligands, cyanide ligands, cyanate ligands, thiocyanate ligands, selenocyanate ligands, tellurocyanate ligands, azide ligands, and organic ligands as described in U.S. Pat. No. 5,360,712 which is incorporated herein by reference. The ligand defined above by E' represents either E, nitrosyl or thionitrosyl.

Preferred transition metal complexes include

TMC-1 $[Ru(NO)Cl_5]^{-2}$
TMC-2 $[Ru(NO)Br_5]^{-2}$
TMC-3 $[Ru(NO)I_5]^{-2}$
TMC-4 $[Ru(NO)F_5]^{-2}$
TMC-5 $[Ru(NO)Cl_3(H_2O)_2]^{0}$
TMC-6 $[Ru(NO)Cl_3(H_2O)_2]^{-1}$
TMC-7 $[Ru(NO)Cl^4(OCN)]^{-2}$
TMC-8 $[Ru(NO)Cl_4(CN)]^{-2}$
TMC-9 $[Ru(NO)I_4(TeCN)]^{-2}$
TMC-10 $[Ru(NO)Cl_4(SCN)]^{-2}$
TMC-11 $[Ru(NO)Br_4(SeCN)]^{-2}$
TMC-12 $[Ru(NO)I_4(SeCN)]^{-2}$
TMC-13 $[Ru(NO)Cl_3(CN)_2]^{-2}$
TMC-14 $[Ru(NO)Br_2(CN)_3]^{-2}$
TMC-15 $[Ru(NO)I_2(CN)_3]^{-2}$
TMC-16 $[Ru(NO)Cl_4(N)_3]^{-2}$
TMC-17 $[Ru(NO)Cl(CN)_4]^{-2}$
TMC-18 $[Ru(NO)Br(SCN)_4]^{-2}$
TMC-19 $[Ru(NO)I(SCN)_4]^{-2}$
TMC-20 $[Ru(NO)I(CN)_5]^{-2}$
TMC-21 $[Os(NO)Cl_5]^{-2}$
TMC-22 $[Os(NO)Br_5]^{-2}$
TMC-23 $[Os(NO)I_5]^{-2}$
TMC-24 $[Os(NO)F_5]^{-2}$
TMC-25 $[Os(NO)Cl_4(TeCN)]^{-2}$
TMC-26 $[Os(NO)Br_4(OCN)]^{-2}$
TMC-27 $[Os(NS)Cl_5]^{-2}$
TMC-28 $[Os(NO)Cl_4(SeCN)]^{-2}$
TMC-29 $[Os(NO)Br_4(SeCN)]^{-2}$
TMC-30 $[Os(NO)I_4(SeCN)]^{-2}$
TMC-31 $[Os(NO)Cl_3(CN)_2]^{-2}$
TMC-32 $[Os(NO)Br_2(CN)_3]^{-2}$
TMC-33 $[Os(NO)I_2(SCN)_3]^{-2}$
TMC-34 $[Os(NO)Cl_2(SCN)_3]^{-2}$
TMC-35 $[Os(NO)Cl(CN)_4]^{-2}$
TMC-36 $[Os(NO)Br(CN)_4]^{-2}$
TMC-37 $[Os(NS)I_5]^{-2}$
TMC-38 $[Os(NO)(CN)_5]^{-2}$
TMC-39 $[Ru(NS)Cl_5]^{-2}$
TMC-40 $[Os(NS)Br_5]^{-2}$
TMC-41 $[Ru(NS)I_5]^{-2}$
TMC-42 $[Os(NS)Cl_4(N_3)]^{-2}$

TMC-43 $[Ru(NS)Br_4(N_3)]^{-2}$
TMC-44 $[Os(NS)I_4(N_3)]^{-2}$
TMC-45 $[Ru(NS)Cl_4(CN)]^{-2}$
TMC-46 $[Os(NS)Br_4(CN)]^{-2}$
TMC-47 $[Ru(NS)I_4(CN)]^{-2}$
TMC-48 $[Os(NS)Cl_4(SCN)]^{-2}$
TMC-49 $[Ru(NS)Br_4(SCN)]^{-2}$
TMC-50 $[Os(NS)I_4(SCN)]^{-2}$
TMC-51 $[Ru(NS)Cl_4(SeCN)]^{-2}$
TMC-52 $[Os(NS)Br_4(SeCN)]^{-2}$
TMC-53 $[Os(NS)F_5]^{-2}$
TMC-54 $[Os(NS)Cl_3(N_3)_2]^{-2}$
TMC-55 $[Ru(NS)Br_3(CN)_2]^{-2}$
TMC-56 $[Os(NS)Cl_3(SCN)_2]^{-2}$
TMC-57 $[Ru(NS)Cl_3(SeCN)_2]^{-2}$
TMC-58 $[Ru(NS)Cl_2(N_3)_3]^{-2}$
TMC-59 $[Os(NS)I_2(CN)_3]^{-2}$
TMC-60 $[Os(NS)Br_2(SCN)_3]^{-2}$
TMC-61 $[Ru(NS)Cl_2(SeCN)_3]^{-2}$
TMC-62 $[Ru(NS)Cl_2(N_3)_3]^{-2}$
TMC-63 $[Os(NS)I_2(CN)_3]^{-2}$
TMC-64 $[Ru(NS)Br_2(SCN)_3]^{-2}$
TMC-65 $[Os(NS)Cl_2(SeCN)_3]^{-2}$
TMC-66 $[Os(NS)Cl_1(N_3)_4]^{-2}$
TMC-67 $[Ru(NS)I(CN)_4]^{-2}$
TMC-68 $[Ru(NS)Cl(SCN)_4]^{-2}$
TMC-69 $[Os(NS)Cl(SeCN)_4]^{-2}$
TMC-70 $[Ru(NS)(CN)_5]^{-2}$
TMC-71 $[Ru(NS)(SCN)_5]^{-2}$
TMC-72 $[Os(NS)(SeCN)_5]^{-2}$
TMC-73 $[Ru(NS)(N_3)_5]^{-2}$
TMC-74 $[Fe(NO)(CN)_5]^{-2}$
TMC-75 $[V(NO)(CN)_5]^{-3}$
TMC-76 $[Cr(NO)(CN)_5]^{-3}$
TMC-77 $[Mn(NO)(CN)_5]^{-3}$

The second grain surface modifier suitable for the invention is also a transition metal complex, and it comprises a transition metal, other than iridium, which is selected from Groups 7 to 10, inclusive, of the periodic table. As such, it includes a transition metal selected from iron, ruthenium, osmium and rhenium. Preferably, the grain surface modifier comprises a transition metal selected from Group 8 of the periodic table.

Preferably, the second grain surface modifier is hexacoordination complex that comprises cyanide ligands. More preferably, it has the structure:

$$[M(CN)_{6-y}L_y]^n$$

wherein

M is defined as a Group 7 to 10 non-iridium transition metal;

L is ligand;

y is 0, 1, 2, or 3; and n is 0, −1, −2, −3, or −4.

Specific examples of ligands include aquo ligands, halide ligands, cyanide ligands, cyanate ligands, thiocyanate ligands, selenocyanate ligands, tellurocyanate ligands, azide ligands, and organic ligands.

Preferred examples of the second grain surface modifier of the claimed invention include:

TMC-78 $[Ru(CN)_6]^{-4}$
TMC-79 $[Os(CN)_6]^{-4}$
TMC-80 $[Fe(CN)_6]^{-4}$
TMC-81 $[RuF(CN)_5]^{-4}$
TMC-82 $[OsF(CN)_5]^{-4}$
TMC-83 $[FeF(CN)_5]^{-4}$
TMC-84 $[RuCl(CN)_5]^{-4}$
TMC-85 $[OsCl(CN)_5]^{-4}$
TMC-86 $[FeCl(CN)_5]^{-4}$
TMC-87 $[RuBr(CN)_5]^{-4}$
TMC-88 $[OsBr(CN)_5]^{-4}$
TMC-89 $[FeBr(CN)_5]^{-4}$
TMC-90 $[RuI(CN)_5]^{-4}$
TMC-91 $[OsI(CN)_5]^{-4}$
TMC-92 $[FeI(CN)_5]^{-4}$
TMC-93 $[RuF_2(CN)_4]^{-4}$
TMC-94 $[OsF_2(CN)_4]^{-4}$
TMC-95 $[FeF_2(CN)_4]^{-4}$
TMC-96 $[RuCl_2(CN)_4]^{-4}$
TMC-97 $[OsCl_2(CN)_4]^{-4}$
TMC-98 $[FeCl_2(CN)_4]^{-4}$
TMC-99 $[RuBr_2(CN)_4]^{-4}$
TMC-100 $[OsBr_2(CN)_4]^{-4}$
TMC-101 $[FeBr_2(CN)_4]^{-4}$
TMC-102 $[RuI_2(CN)_4]^{-4}$
TMC-103 $[OsI_2(CN)_4]^{-4}$
TMC-104 $[FeI_2(CN)_4]^{-4}$
TMC-105 $[Ru(CN)_5(OCN)]^{-4}$
TMC-106 $[Os(CN)_5(OCN)]^{-4}$
TMC-107 $[Fe(CN)_5(OCN)]^{-4}$
TMC-108 $[Ru(CN)_5(SCN)]^{-4}$
TMC-109 $[Os(CN)_5(SCN)]^{-4}$
TMC-110 $[Fe(CN)_5(SCN)]^{-4}$
TMC-111 $[Ru(CN)_5(N_3)]^{-4}$
TMC-112 $[Os(CN)_5(N_3)]^{-4}$
TMC-113 $[Fe(CN)_5(N_3)]^{-4}$
TMC-114 $[Ru(CN)_5(H_2O)]^{-3}$
TMC-115 $[Os(CN)_5(H_2O)]^{-3}$
TMC-116 $[Fe(CN)_5(H_2O)]^{-3}$
TMC-117 $[Ru(SCN)_6]^{-4}$
TMC-118 $[Os(SCN)_6]^{-4}$
TMC-119 $[Fe(SCN)_6]^{-4}$
TMC-120 $[Ru(OCN)_6]^{-4}$
TMC-121 $[Os(OCN)_6]^{-4}$
TMC-122 $[Fe(OCN)_6]^{-4}$
TMC-123 $[Pt(CN)_4]^{-2}$
TMC-124 $[Pt(CN)_4Cl_2]^{-2}$
TMC-125 $[Pt(CN)_4Br_2]^{-2}$
TMC-126 $[Pt(CN)_4I_2]^{-2}$

The iridium containing hexacoordination complex can be incorporated into the emulsion as either a dopant or as a grain surface modifier. As a dopant, the iridium containing hexacoordination complex can be incorporated anywhere within the internal structure of the silver halide grains. For instance, it is contemplated that the complex be incorporated through at least 50 percent, at least 75 percent, or at least 90 percent of the volume of the silver halide grains. It is preferred, though, that it be banded throughout the outer 80–98 percent region of the grains, the region being defined with respect to the total volume of the grains. It is more preferred that the complex be banded in the region comprising the outer 85–95 percent of the volume of the grains. Optimally, it is banded in the outer 90–95 percent.

It is also specifically contemplated that the hexacoordination complex comprising iridium be incorporated on the surface of the silver halide grains as a grain surface modifier. In this regard, application of such a complex can be as described above with respect to the other grain surface modifiers. It is preferred that when the hexacoordination complex be applied to the grains in a Lippmann halide carrier, that the carrier account for no more than about two, and preferably no more than about one, mole percent of the total halide in the silver halide grains.

The iridium containing hexacoordination complex preferably has the structure:

to $R_qIrX_6$ wherein

R represents a hydrogen atom, an alkali metal atom, or an ammonium radical;

q is 2, 3 or 4; and

X represents a ligand, preferably a halogen ligand (e.g., a chlorine or bromine atom) or other anionic ligand, or an organic ligand as described in U.S. Pat. No. 5,360,712.

Exemplary ligands include aquo ligands, halide ligands, cyanide ligands, cyanate ligands, thiocyanate ligands, selenocyanate ligands, tellurocyanate ligands, and azide ligands. Combinations of the above ligands are also contemplated. It is preferred that the ligands be other than nitrosyl or thionitrosyl ligands.

The hexacoordination complex comprising iridium is water soluble. When dissolved in water, $R_q$ dissociates as cations while the iridium atom and the ligands disperse as a hexacoordination anionic complex.

The hexacoordination complex exhibits a spatial configuration that is compatible with the face centered cubic crystal lattice prevalent in photographically useful silver halides. The six ligands are spatially comparable to the six halide ions that are adjacent to a silver ion in the crystal structure. Thus, they may in fact be halide ions. They may also be any ligand, single or multielemental, that is capable of being spatially and electrically accommodated into the silver halide crystal lattice.

Specific examples of the hexacoordination complex comprising iridium include $K_2IrCl_6$, $K_3IrCl_6$, $K_2IrBr_6$, $K_3IrBr_6$, $K_2IrCl_5$ ($H_2O$), $K_2IrCl_5$ (thiazole) and $K_2IrBr_5$ (pyrazine), $K_3Ir(CN)_6$, $K_3Ir(CN)_5Cl$, $K_3I(CN)_4I_2$ and $K_4Ir(CN)_6$.

Although the grain surface modifiers and the hexacoordination complex comprising iridium can be applied to a photographic emulsion comprising any type of silver halide grains, it is preferred that they be used in a silver chloride emulsion which has been ripened in the presence of a ripening agent.

It is preferred that the first grain surface modifier be applied to the emulsion in an amount between about $7.5\times10^{-10}$ and about $3.0\times10^{-8}$ moles per mole of silver halide. More preferably, it is applied in an amount between about $1.0\times10^{-9}$ and about $2.0\times10^{-8}$ moles per mole of silver halide. Optimally, it is in an amount between about $3.0\times10^{-9}$ and about $1.8\times10^{-8}$ moles per mole of silver halide.

It is preferred that the second grain surface modifier be applied to the emulsion in an amount between about $1.0\times10^{-6}$ and about $5.0\times10^{-4}$ moles per mole of silver halide. More preferably, it is applied in an amount between about $1.0\times10^{-6}$ and about $4.0\times10^{-5}$ moles per mole of silver halide. Optimally, it is in an amount between about $3.9\times10^{-6}$ and about $3.2–10^{-5}$ moles per mole of silver halide.

The hexacoordination complex comprising iridium preferably is applied in an amount between about $1.0\times10^{-9}$ and about $1.0\times10^{-4}$ moles per mole of silver halide, regardless of whether it is applied as a dopant or grain surface modifier. The hexacoordination complex is more preferably applied in an amount about $2.0\times10^{-9}$ and about $1.0\times10^{-5}$ moles per mole of silver halide. Optimally, it is applied in an amount between about $5.0\times10^{-9}$ and about $5.0\times10^{-6}$ moles per mole of silver halide.

The silver halide grains capable of being used in the present invention are of any known type. They can be formed of bromide ions as the sole halide, chloride ions as the sole halide, or any mixture of the two. They may also have incorporated within them, minor amounts of iodide ions. Generally, though, iodide concentrations in silver halide grains seldom exceed 20 mole percent and are typically less than 10 mole percent, based on silver. However, specific applications differ widely in their use of iodide. In high speed (ASA 100 or greater) camera films, silver bromoiodide emulsions are employed since the presence of iodide allows higher speeds to be realized at any given level of granularity. In radiography, silver bromide emulsions or silver bromoiodide emulsions containing less than 5 mole percent iodide are customarily employed. Emulsions employed for the graphic arts and color paper, by contrast, typically contain greater than 50 mole percent chloride. Preferably they contain greater than 70 mole percent, and optimally greater than 85 mole percent, chloride. The remaining halide in such emulsions is preferably less than 5 mole percent, and optimally less than 2 mole percent, iodide, with any balance of halide not accounted for by chloride or iodide being bromide.

The advantages of the invention would be present in any of the above-mentioned types of emulsions, although it is preferred that the emulsions comprise silver chloride grains which are substantially free of silver bromide or silver iodide. By substantially free, it is meant that such grains are greater than about 90 mole percent silver chloride. Preferably, silver chloride accounts for greater than about 95 mole percent of the silver halide in the emulsion. Optimally, it accounts for about 97–99 mole percent.

The invention may be practiced with any of the known techniques for emulsion preparation. Such techniques include those which are normally utilized, for instance single jet or double jet precipitation; or they may include forming a silver halide emulsion by the nucleation of silver halide grains in a separate mixer or first container with later growth in a second container. All of these techniques are referenced in the patents discussed in *Research Disclosure*, December 1989, Item 308119, Sections I–IV at pages 993–1000.

After precipitation of the silver halide grains, the emulsions are washed to remove excess salt. At this time the grain surface modifiers of the present invention may be added, or they may be added at a later time such as during chemical or spectral sensitization. Both chemical and spectral sensitization may be performed in any conventional manner as disclosed in the above-referenced *Research Disclosure*, Item 308119. The hexacoordination complex comprising iridium can be added during precipitation of the grains or during chemical or spectral sensitization. Incorporated herein by reference are U.S. Pat. Nos. 5,256,530 and 5,252,451 which disclose suitable methods for applying dopants and grain surface modifiers to the emulsions of the present invention.

As noted, the present invention may be practiced with silver halide grains having any halide composition. The invention may also be practiced with silver halide grains having any form (i.e. cubic, octahedral, dodecahedral, spherical or tabular). It is preferred, however, that the present invention be practiced with tabular grains having an aspect ratio greater than 2:1, preferably at least 5:1, and optimally at least 7:1. Aspect ratio as used herein is understood to mean the ratio of the equivalent circular diameter of a grain to its thickness. The equivalent circular diameter of a grain is the diameter of a circle having an area equal to the projected area of the grain.

The photographic emulsions of the present invention may be incorporated into photographic elements as are known in the art. These may include simple single layer elements or multilayer, multicolor elements. Multicolor elements contain dye image-forming units sensitive to each of the three primary regions of the visible light spectrum. Each unit can be comprised of a single emulsion layer or of multiple emulsion layers sensitive to a given region of the spectrum. In addition, each unit's emulsion layers can be comprised of a blend of two or more distinct emulsions having particular characteristics with respect to curve shape. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 microns.

In the following discussion of suitable materials for use with or in the emulsions of this invention, reference will be made to *Research Disclosure*, December 1978, Item 17643, and *Research Disclosure*, December 1989, Item 308119, both published by Kenneth Mason Publications, Ltd., Dudley Annex, 12a North Street, Emsworth, Hampshire PO10 7DQ, ENGLAND, the disclosures of which are incorporated herein by reference. These publications will be identified hereafter by the term "Research Disclosure." A reference to a particular section in "Research Disclosure" corresponds to the appropriate section in each of the above-identified *Research Disclosures.*

As noted above, the silver halide emulsions employed in this invention can be comprised of silver bromide, silver chloride, silver iodide, silver bromochloride, silver iodochloride, silver iodobromide, silver iodobromochloride or mixtures thereof. The emulsions can include silver halide grains of any conventional shape or size. Specifically, the emulsions can include coarse, medium or fine silver halide grains. High aspect ratio tabular grain emulsions are specifically contemplated, such as those disclosed by Wilgus et al. U.S. Pat. No. 4,434,226, Daubendiek et al. U. S. Pat. No. 4,414,310, Wey U.S. Pat. No. 4,399,215, Solberg et al. U.S. Pat. No. 4,433,048, Mignot U.S. Pat. No. 4,386,156, Evans et al. U.S. Pat. No. 4,504,570, Maskasky U.S. Pat. No. 4,400,463, Wey et al. U.S. Pat. No. 4,414,306, Maskasky U.S. Pat. Nos. 4,435,501 and 4,643,966 and Daubendiek et al. U.S. Pat. Nos. 4,672,027 and 4,693,964, all of which are incorporated herein by reference. Also specifically contemplated are those silver iodobromide grains with a higher mole proportion of iodide in the core of the grain than in the periphery of the grain, such as those described in British Reference No. 1,027,146; Japanese Reference No. 54/48,521; U.S. Pat. Nos. 4,379,837; 4,444,877; 4,665,012; 4,686,178; 4,565,778; 4,728,602; 4,668,614 and 4,636,461; and in European Reference No 264,954, all of which are incorporated herein by reference. The silver halide emulsions can be either monodisperse or polydisperse as precipitated. The grain size distribution of the emulsions can be controlled by silver halide grain separation techniques or by blending silver halide emulsions of differing grain sizes.

Dopants may be added to the emulsions. Examples of dopants include compounds of copper, thallium, lead, bismuth, cadmium and Group VIII noble metals. The dopants can include transition metal complexes as described in U.S. Pat. Nos. 4,981,781, 4,937,180, and 4,933,272.

The emulsions can be surface-sensitive emulsions, i.e., emulsions that form latent images primarily on the surface of the silver halide grains; or internal latent image-forming emulsions, i.e., emulsions that form latent images predominantly in the interior of the silver halide grains. The emulsions can be negative-working emulsions such as surface-sensitive emulsions or unfogged internal latent image-forming emulsions, but can also be direct-positive emulsions of the unfogged, internal latent image-forming type, which are positive-working when development is conducted with uniform light exposure or in the presence of a nucleating agent.

The silver halide emulsions can further be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure*, Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, stryryls, merostyryls, and streptocyanines. Illustrative spectral sensitizing dyes are disclosed in *Research Disclosure*, Item 308119, cited above, Section IV.

Suitable vehicles for the emulsion layer and other layers of the photographic elements are described in *Research Disclosure*, Item 308119, Section IX and the publications cited therein.

The elements can include couplers as described in *Research Disclosure*, Section VII, paragraphs D, E, F, and G and the publications cited therein. The couplers can be incorporated as described in *Research Disclosure*, Section VII, paragraph C, and the publications cited therein. Also contemplated are elements which further include image modifying couplers as described in *Research Disclosure*, Item 308119, Section VII, paragraph F.

The photographic elements can contain brighteners (*Research Disclosure*, Section V), antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl-1,3,3a,7-tetraazaindene), and those described in *Research Disclosure*, Section VI, antistain agents and image dye stabilizers (*Research Disclosure*, Section VII, paragraphs I and J), light absorbing and scattering materials (*ReSearch Disclosure*, Section VIII), hardeners (*Research Disclosure*, Section X), polyalkyleneoxide and other surfactants as described in U.S. Pat. No. 5,236,817, coating aids (*Research Disclosure*, Section XI), plasticizers and lubricants (*Research Disclosure*, Section XII), antistatic agents (*Research Disclosure*, Section XIII), matting agents (*Research Disclosure*, Section XII and XVI) and development modifiers (*Research Disclosure*, Section XXI.

The photographic elements can be coated on a variety of supports as described in *Research Disclosure*, Section XVII and the references described therein.

The photographic elements can be incorporated into single use cameras. Single use cameras are known in the art under various names: film with lens, photosensitive material package unit, box camera and photographic film package. Other names are also used, but regardless of the name, each shares a number of common characteristics. Each is essentially a photographic product (camera) provided with an exposure function and preloaded with a photographic material. The photographic product comprises an inner camera shell loaded with the photographic material, a lens opening and lens, and an outer wrapping(s) of some sort. The photographic material is exposed in a similar manner as any photographic materials are exposed in cameras, and then the product is sent to the developer who removes the photographic material and develops it. Return of the product to the consumer does not normally occur.

Single use cameras and their methods of manufacture and use are described in U.S. Pat. Nos. 4,801,957, 4,901,097, 4,866,469, 4,849,325, 4,751,536, 4,827,298, European Patent Applications 0 460 400, 0 533 785, 0 537 908, 0 578 225, all of which are incorporated herein by reference.

The photographic elements can be exposed to actinic radiation, typically in the visible region of the spectrum, to form a latent image as described in *Research Disclosure*, Section XVIII, and then processed to form a visible dye image as described in *Research Disclosure*, Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-HN,N-diethylaniline hydrochloride, 4-amino-3-methyl-N-ethyl-N-(b-methanesulfonamidoethyl)-aniline sulfate hydrate, 4-amino-3-methyl-N-ethyl-N-(b-hydroxyethyl)-aniline sulfate, 4-amino-3-(b-methanesulfonamidoethyl)-N,N-diethylaniline hydrochloride, and 4-amino-N-ethyl-N-(b-methoxyethyl)-m-toludine di-p-toluenesulfonic acid.

With negative-working silver halide emulsions, the processing step described above provides a negative image. The described elements can be processed in the known C-41 or RA-4 color process. To provide a positive (or reversal) image, the color development step can be preceded by development with a non-chromogenic developing agent to develop exposed silver halide, but not form dye, and then uniformly fogging the element to render unexposed silver halide developable. Reversal processing of the element is preferably done in accordance with the known E6 process as described and referenced in *Research Disclosure* paragraph XIX. Alternatively, a direct positive emulsion can be employed to obtain a positive image.

Development is followed by the conventional steps of bleaching, fixing, or bleach-fixing, to remove silver or silver halide, washing, and drying.

The invention can be better appreciated by reference to the following specific examples. They are intended to be illustrative and not exhaustive of the grains of the present invention and their methods of formation.

EXAMPLES

Examples 1–6 were prepared in such a manner that the grain surface modifiers were applied in a Lippmann bromide emulsion that accounted for about 0.6 mole percent of the total silver halide of the grains.

In Examples 1 and 2, the iridium containing hexacoordination complex was utilized as a dopant and was banded in each grain in the 93 to 95 percent region (as defined by volume). In Examples 3 to 6, the iridium containing hexacoordination complex was utilized as a grain surface modifier. It was applied in a similar manner as the other grain surface modifiers.

The emulsions for examples 1–6 were prepared by conventional precipitation methods employing thioether silver halide ripening agents of the type disclosed in McBride U.S. Pat. No. 3,271,157.

The emulsions were coated on paper support using sizing methods disclosed in U.S. Pat. No. 4,994,147. Specifically, they were coated at 0.28 grams/$m^2$ silver with 0.002 grams/$m^2$ of 2,4-dihydroxy-4-methyl-1piperidinocyclopenten-3-one, 0.02 grams/$m^2$ of KCl, 0.78 mg/$m^2$ of potassium tolylthiosulfonate, 7.8 mg/$m^2$ of sodium tolylsulfinate, 1.08 grams/$m^2$ yellow dye forming coupler N-(5-((4-(2,4-bis(1,1-dimethylpropyl)phenoxy)-1-oxobutyl)amino)-2-chlorophenyl)-4,4-dimethyl-3-oxo-2-(4-(( 4-(phenylmethoxy)phenyl)sulfony)phenoxy)-pentanamide, and 0.166 grams/$m^2$ gelatin. A gelatin protective overcoat layer 1.1 grams/$m^2$ was applied along with a vinylsulfone gelatin hardener.

The coatings were exposed through a step tablet to a 3000° K. light source for 0.1 second and processed as recommended in "Using KODAK EKTACOLOR RA Chemicals", Publication No. Z-130, published by Eastman Kodak Co., 1990. After processing, the Status A reflection densities of each coating were measured.

A series of Lippmann bromide carrier emulsions was prepared for the addition of $Os(NO)Cl_5$, $Os(NS)Cl_5$, $Fe(CN)_6$, $Ru(CN)_6$, $Os(CN)_6$ and $K_2IrCl_6$ as grain surface modifiers. Lippmann bromide carriers were prepared as follows:

Emulsion L-1:

A reaction vessel containing 4.0 liters of a 5.6 percent by weight gelatin aqueous solution was adjusted to a temperature of 40° C., a pH of 5.8, and a pAg of 8.86 by addition of AgBr solution. A 2.5 molar solution containing 1698.7 grams of $AgNO_3$ in water and a 2.5 molar solution containing 1028.9 grams of NaBr in water were simultaneously run into the reaction vessel with rapid stirring. The double jet precipitation continued for 3 minutes at a controlled pAg of 8.86, after which the precipitation was continued for 17 minutes. The pAg during this period was decreased linearly from 8.86 to 8.06. A total of 10 moles of silver bromide (Lippmann bromide) was precipitated, the silver bromide having average grain sizes of 0.05 microns.

Emulsion L-2:

Emulsion L-2 was prepared exactly as Emulsion L-1 except 0.011 grams of $Cs_2Os(NO)Cl_5$ were added to the 2.5 molar NaBr solution. This double jet precipitation produced 10 moles of a 0.05 micron particle diameter emulsion containing $1.66\times10^{-6}$ moles $Os(NO)Cl_5$ per mole silver bromide.

Emulsion L-3:

Emulsion L-3 was prepared exactly as Emulsion L-1 except 0.00816 grams of $K_2Os(NS)Cl_5$ were added to the 2.5 molar NaBr solution. This double jet precipitation produced 10 moles of a 0.05 micron particle diameter emulsion containing $1.66\times10^{-6}$ moles $Os(NS)Cl_5$ per mole silver bromide.

Emulsion L-4:

Emulsion L-4 was prepared exactly as Emulsion L-1 except 14.78 grams of $K_4Fe(CN)_6.3(H_{20})$ were added to the 2.5 molar NaBr solution during the initial 35 percent of the double jet precipitation. This double jet precipitation produced 10 moles of a 0.05 micron particle diameter emulsion containing $3.5\times10^{-3}$ moles $Fe(CN)_6$ per mole silver bromide.

Emulsion L-5:

Emulsion L-5 was prepared exactly as Emulsion L-1 except 14.47 grams of $K_4Ru(CN)_6$ were added to the 2.5 molar NaBr solution during the initial 35 percent of the double jet precipitation. This double jet precipitation produced 10 moles of a 0.05 micron particle diameter emulsion containing $3.5\times10^{-3}$ moles $Ru(CN)_6$ per mole silver bromide.

Emulsion L-6:

Emulsion L-6 was prepared exactly as Emulsion L-1 except 17.59 grams of $K_4Os(CN)_6$ were added to the 2.5 molar NaBr solution during the initial 35 percent of the double jet precipitation. This double jet precipitation produced 10 moles of a 0.05 micron particle diameter emulsion containing $3.5\times10^{-3}$ moles $Os(CN)_6$ per mole silver bromide.

Emulsion L-7:

Emulsion L-7 was prepared exactly as Emulsion L-1 except 0.075 grams of $K_2IrCl_6$ were added to the 2.5 molar NaBr solution during 75–80 percent of the double jet precipitation. This double jet precipitation produced 10 moles of a 0.05 micron particle diameter emulsion containing $1.5\times10^{-5}$ moles $K_2IrCl_6$ per mole silver bromide.

EXAMPLE 1

Emulsion 1 was prepared in a reaction vessel wherein 8.5 liters of a 2.8 percent by weight gelatin aqueous solution and 1.8 grams of 1,8-dihydroxy-3,6-dithiaoctane was adjusted to a temperature of 68.3° C., pH of 5.8, and a pAg of 7.35 by addition of NaCl solution. A 3.75 molar solution containing 1658.0 grams of $AgNO_3$ in water and a 3.75 molar solution containing 570.4 grams of NaCl in water were simultaneously run into the reaction vessel with rapid stirring. The double jet precipitation was controlled at a pAg of 7.35. A total of 9.76 moles of silver chloride was precipitated, the grains having cubic morphology of 0.60 micron average edge length.

Emulsion 1 was spectrally and chemically sensitized by heating a 50 millimole (mmole) sample of the emulsion to 40° C., adding 280 milligrams of yellow spectral sensitizing dye anhydro 3,3'-di-3-sulfopropyl-5'-chloro-naphtho[1,2-d] thiazolothiacyanine hydroxide, tetrabutylammonium salt, and then adding 0.3 mmoles of Emulsion L-1. The temperature was raised to 60° C. to accelerate application of the Lippmann bromide to the grain surfaces. Addition of sodium thiosulfate and 4-hydroxy-6-methyl-1,3,3a,7-tetraazaindene followed and the emulsion was maintained at 60° C. Addition of 1-(3-acetamidophenyl)-5-mercaptotetrazole followed to complete the spectral and chemical sensatization.

Emulsion 2 was prepared and sensitized exactly as Emulsion 1 except that 0.06 moles of Emulsion L-2 and 0.24 mmoles of Emulsion L-1 were added during the sensitization process instead of 0.3 mmoles of Emulsion L-1. Thus, $3.0\times10^{-9}$ moles of $Os(NO)Cl_5$ per mole silver chloride were added to Emulsion 2 as a grain surface modifier.

Emulsion 3 was prepared and sensitized exactly as Emulsion 1 except that 0.1125 mmoles of Emulsion L-4 and 0.1875 mmoles of Emulsion L-1 were added during the sensitization process instead of 0.3 mmoles of Emulsion L-1. Thus, $11.8\times10^{-6}$ moles of $Fe(CN)_6$ per mole silver chloride were added to Emulsion 3 as a grain surface modifier.

Emulsion 4 was prepared exactly as Emulsion 1 except 0.145 milligrams of $K_3IrCl_6$ were added to the 3.75 NaCl solution during 93–95 percent of the double jet precipitation. A total of 9.76 moles of silver chloride containing $28.5\times10^{-9}$ moles $K_3IrCl_6$ per mole silver chloride were precipitated. The morphology was cubic with an average cubic edge length of 0.60 microns.

Emulsion 5 was prepared and sensitized exactly as Emulsion 3 except that Emulsion 4 was used instead of Emulsion 1. Thus, $11.8\times10^{-6}$ moles of $Fe(CN)_6$ per mole silver chloride were added to Emulsion 5 as a grain surface modifier, while $28.5\times10^{-9}$ moles of $K_3IrCl_6$ per mole silver chloride were added as a dopant.

Emulsion 6 was prepared and sensitized exactly as Emulsion 2 except that Emulsion 4 was used instead of Emulsion 1. Thus, $3.0\times10^{-9}$ moles of $Os(NO)Cl_5$ per mole silver chloride were added to Emulsion 6 as a grain surface modifier, while $28.5\times10^{-9}$ moles of $K_3IrCl_6$ per mole silver chloride were added as a dopant.

Emulsion 7 was prepared and sensitized exactly as Emulsion 1 except that 0.06 mmoles of Emulsion L-2, 0.1125 mmoles of Emulsion L-4 and 0.1275 mmoles of Emulsion L-1 were added during the sensitization process instead of 0.3 mmoles of Emulsion L-1. Thus, $3.0\times10^{-9}$ moles of $Os(NO)Cl_5$ per mole silver chloride and $11.8\times10^{-6}$ moles of $Fe(CN)_6$ per mole silver chloride were each added to Emulsion 7 as a grain surface modifier.

Emulsion 8 was prepared and sensitized exactly as Emulsion 7 except that Emulsion 4 was used instead of Emulsion 1. Thus, $3.0\times10^{-9}$ moles of $Os(NO)Cl_5$ per silver and $11.8\times10^{-6}$ moles of $Fe(CN)_6$ per mole silver chloride were each added to Emulsion 8 as a grain surface modifier, while $28.5\times10^{-9}$ moles of $K_3IrCl_6$ per mole silver chloride were added as a dopant.

Example 1

| | Grain Surface Modifier | | | | | Percent | | Percent |
|---|---|---|---|---|---|---|---|---|
| Emulsion | $Os(NO)Cl_5$[1] | $Fe(CN)_6$[2] | Ir[3] | Speed[4] | Gamma[5] | Gamma Change | Toe Density[6] | Toe Change |
| 1 | — | — | — | 133 | 2.01 | — | 0.506 | — |
| 2 | 3.0 | — | — | 125 | 2.70 | +34 | 0.384 | −24 |
| 3 | — | 11.8 | — | 164 | 2.14 | +6 | 0.462 | −9 |
| 4 | — | — | 28.5 | 155 | 1.68 | −16 | 0.453 | −10 |
| 5 | — | 11.8 | 28.5 | 176 | 2.82 | +40 | 0.350 | −31 |
| 6 | 3.0 | — | 28.5 | 141 | 2.95 | +47 | 0.278 | −45 |
| 7 | 3.0 | 11.8 | — | 145 | 3.00 | +49 | 0.294 | −42 |
| 8 | 3.0 | 11.8 | 28.5 | 151 | 3.73 | +86 | 0.185 | −63 |

[1]Mole parts per billion $Os(NO)Cl_5$/mole AgCl (TMC-21)

-continued

Example 1

| Emulsion | Grain Surface Modifier $Os(NO)Cl_5$[1] | Grain Surface Modifier $Fe(CN)_6$[2] | Ir[3] | Speed[4] | Gamma[5] | Percent Gamma Change | Toe Density[6] | Percent Toe Change |
|---|---|---|---|---|---|---|---|---|

[2]Mole parts per million $Fe(CN)_6$/mole AgCl (TMC-80)
[3]Mole parts per billion $K_3Ir(Cl)_6$ incorporated as a dopant in the 93–95% band (by volume of silver halide grains).
[4]The reciprocal of the relative amount of light in LogEx100 to produce 1.0 density speed point.
[5]Slope of a line tangent to the sensitometric curve at the speed point.
[6]The density value of the point 0.3 LogE fast of the speed point.

Relative to Emulsion 1, inventive Emulsion 8 showed an increase in Gamma and decrease in Toe Density in excess of the sum of Emulsions 2–4, where each compound was used alone. The increase in Gamma and decrease in Toe Density for Emulsion 8 was also greater than the sum of Emulsions 2 and 5, Emulsions 3 and 6, or Emulsions 4 and 7, where specific combinations of the compounds were utilized.

The above Example demonstrates that an unexpected improvement in photographic contrast can be obtained when a combination of grain surface modifiers and a hexacoordination complex comprising iridium are incorporated into a photographic emulsion.

EXAMPLE 2

Emulsions 9, 10, 12 and 14 were prepared exactly as Emulsions 1, 2, 4 and 6, respectively. Emulsions 11, 13, 15 and 16 were prepared by the same procedures used in preparing Emulsions 3, 5, 7 and 8, respectively, except that by the use of Emulsion L-5 instead of Emulsion L-4, $Ru(CN)_6$ was added as a grain surface modifier instead of $Fe(CN)_6$.

a hexacoordination complex comprising iridium are incorporated into a photographic emulsion.

Examples 3–7, shown below, demonstrate that the advantages of the invention are present when the hexacoordination complex comprising iridium is utilized as a grain surface modifier, and when alternative grain surface modifiers are used. The examples also demonstrate that present invention provides a means by which to advantageously control the shoulder density of a given photographic emulsion sensitometric curve. Thus, the present invention provides a means by which to control tone reproduction in photographic elements.

EXAMPLE 3

Emulsions 17 and 18 were prepared exactly as Emulsions 1 and 2, respectively. Emulsion 19 was prepared by the same procedures as Emulsion 3, except a reduced amount of $7.9\times10^{-6}$ moles per mole silver chloride of $Fe(CN)_6$ was added as a grain surface modifier by the addition of 0.075 mmoles of Emulsion L-4 and 0.225 mmoles of Emulsion L-1 during the sensitization process.

Example 2

| Emulsion | Grain Surface Modifier $Os(NO)Cl_5$[1] | Grain Surface Modifier $Ru(CN)_6$[2] | Ir[3] | Speed[4] | Gamma[5] | Percent Gamma Change | Toe Density[6] | Percent Toe Change |
|---|---|---|---|---|---|---|---|---|
| 9 | — | — | — | 133 | 2.01 | — | 0.506 | — |
| 10 | 3.0 | — | — | 125 | 2.70 | +34 | 0.384 | −24 |
| 11 | — | 11.8 | — | 163 | 2.09 | +4 | 0.476 | −6 |
| 12 | — | — | 28.5 | 155 | 1.68 | −16 | 0.453 | −10 |
| 13 | — | 11.8 | 28.5 | 175 | 2.74 | +36 | 0.353 | −30 |
| 14 | 3.0 | — | 28.5 | 141 | 2.95 | +47 | 0.278 | −45 |
| 15 | 3.0 | 11.8 | — | 139 | 3.09 | +54 | 0.295 | −42 |
| 16 | 3.0 | 11.8 | 28.5 | 148 | 3.89 | +94 | 0.187 | −63 |

[1]Mole parts per billion $Os(NO)Cl_5$/mole AgCl (TMC-21)
[2]Mole parts per million $Ru(CN)_6$/mole AgCl (TMC-78)
[3]Mole parts per billion $K_3Ir(Cl)_6$ incorporated as a dopant in the 93–95% band (by volume of silver halide grains).
[4]The reciprocal of the relative amount of light in LogEx100 to produce 1.0 density.
[5]Slope of a line tangent to the sensitometric curve at the speed point.
[6]The density value of the point 0.3 LogE fast of the speed point.

Relative to Emulsion 9, inventive Emulsion 16 showed an increase in Gamma and decrease in Toe Density in excess of the sum of Emulsions 10–12, where each compound was used alone. The increase in Gamma and decrease in Toe Density for Emulsion 16 was also greater than the sum of Emulsions 10 and 13, Emulsions 11 and 14, or Emulsions 12 and 15, where specific combinations of the compounds were utilized.

As with Example 1, Example 2 demonstrates that an unexpected improvement in photographic contrast can be obtained when a combination of grain surface modifiers and Emulsion 20 was prepared and sensitized exactly as Emulsion 1 except that 0.03 mmoles of Emulsion L-7 and 0.27 mmoles of Emulsion L-1 were added during the sensitization process instead of 0.3 mmoles of Emulsion L-1. Thus, $14.0\times10^{-9}$ moles of $K_2IrCl_6$ per mole silver chloride were added to Emulsion 20 as a grain surface modifier.

Emulsion 21 was prepared and sensitized exactly as Emulsion 1 except that 0.075 mmoles of Emulsion L-4, 0.03 mmoles of Emulsion L-7 and 0.195 mmoles of Emulsion L-1 were added during the sensitization process instead of 0.3 mmoles of Emulsion L-1. Thus, $7.9\times10^{-6}$ moles of $Fe(CN)_6$ per mole silver chloride and $14.0\times10^{-9}$ moles of $K_2IrCl_6$ per mole silver chloride were each added to Emulsion 21 as a grain surface modifier.

Emulsion 22 was prepared and sensitized exactly as Emulsion 1 except that 0.06 mmoles of Emulsion L-2, 0.03 mmoles of Emulsion L-7 and 0.18 mmoles of Emulsion L-1 were added during the sensitization process instead of 0.3 mmoles of Emulsion L-1. Thus, $3.0\times10^{-9}$ moles of $Os(NO)Cl_5$ per mole silver chloride and $14.0\times10^{-9}$ moles of $K_2IrCl_6$ per mole silver chloride were each added to Emulsion 22 as a grain surface modifier.

Emulsion 23 was prepared and sensitized exactly as Emulsion 1 except that 0.06 mmoles of Emulsion L-2, 0.075 mmoles of Emulsion L-4 and 0.165 mmoles of Emulsion L-1 were added during the sensitization process instead of 0.3 mmoles of Emulsion L-1. Thus, $3.0\times10^{-9}$ moles of $Os(NO)Cl_5$ per mole silver chloride and $7.9\times10^{-6}$ moles of $Fe(CN)_6$ per mole silver chloride were each added to Emulsion 23 as a grain surface modifier.

Emulsion 24 was prepared and sensitized exactly as Emulsion 1 except that 0.06 mmoles of Emulsion L-2, 0.075 mmoles of Emulsion L-4, 0.03 mmoles of Emulsion L-7, and 0.135 mmoles of Emulsion L-1 were added during the sensitization process instead of 0.3 mmoles of Emulsion L-1. Thus, $3.0\times10^{-9}$ moles of $Os(NO)Cl_5$ per mole silver chloride, $7.9\times10^{-6}$ moles of $Fe(CN)_6$ per mole silver chloride, and $14.0\times10^{-9}$ moles of $K_2IrCl_6$ per mole silver chloride were each added to Emulsion 24 as a grain surface modifier.

sensitization process instead of 0.3 moles of Emulsion L-1. Thus, $7.9\times10^{-6}$ moles of $Ru(CN)_6$ per mole silver chloride were added to Emulsion 27 as a grain surface modifier.

Emulsion 28 was prepared and sensitized exactly as Emulsion 1 except that 0.015 moles of Emulsion L-7 and 0.285 mmoles of Emulsion L-1 were added during the sensitization process instead of 0.3 mmoles of Emulsion L-1. Thus, $7.0\times10^{-9}$ moles of $K_2IrCl_6$ per silver was added to Emulsion 28 as a grain surface modifier.

Emulsion 29 was prepared and sensitized exactly as Emulsion 1 except that 0.075 moles of Emulsion L-5, 0.015 mmoles of Emulsion L-7 and 0.21 mmoles of Emulsion L-1 were added during the sensitization process instead of 0.3 mmoles of Emulsion L-1. Thus, $7.9\times10^{-6}$ moles of $Ru(CN)_6$ per mole silver chloride and $7.0\times10^{-9}$ moles of $K_2IrCl_6$ per mole silver chloride were each added to Emulsion 29 as a grain surface modifier.

Emulsion 30 was prepared and sensitized exactly as Emulsion 1 except that 0.06 mmoles of Emulsion L-2, 0.015 mmoles of Emulsion L-7 and 0.225 mmoles of Emulsion L-1 were added during the sensitization process instead of 0.3 moles of Emulsion L-1. Thus, $3.0\times10^{-9}$ moles of $Os(NO)Cl_5$ per mole silver chloride and $7.0\times10^{-9}$ moles of $K_2IrCl_6$ per mole silver chloride were each added to Emulsion 30 as a grain surface modifier.

Emulsion 31 was prepared in the same way as Emulsion 19 except that Emulsion L-5 was used instead of Emulsion L-4. Thus, $3.0\times10^{-9}$ moles of $Os(NO)Cl_5$ per silver and $7.9\times10^{-6}$ moles of $Ru(CN)_6$ per mole silver chloride were each added to Emulsion 31 as a grain surface modifier.

Example 3

| | Grain Surface Modifier | | | | | Percent Gamma | Shoulder | Percent Shoulder |
|---|---|---|---|---|---|---|---|---|
| Emulsion | $Os(NO)Cl_5$[1] | $Fe(CN)_6$[2] | Ir[3] | Speed[4] | Gamma[5] | Change | Density[6] | Change |
| 17 | — | — | — | 131 | 2.39 | — | 1.93 | — |
| 18 | 3.0 | — | — | 122 | 2.91 | +22 | 2.02 | +5 |
| 19 | — | 7.9 | — | 149 | 2.30 | −4 | 1.84 | −4 |
| 20 | — | — | 14.0 | 155 | 1.77 | −26 | 1.48 | −23 |
| 21 | — | 7.9 | 14.0 | 167 | 2.70 | +13 | 1.66 | −14 |
| 22 | 3.0 | — | 14.0 | 138 | 2.96 | +15 | 1.76 | −9 |
| 23 | 3.0 | 7.9 | — | 137 | 3.45 | +44 | 2.06 | +7 |
| 24 | 3.0 | 7.9 | 14.0 | 145 | 4.35 | +82 | 2.01 | +4 |

[1]Mole parts per billion $Os(NO)Cl_5$/mole AgCl (TMC-21)
[2]Mole parts per million $Fe(CN)_6$/mole AgCl (TMC-80
[3]Mole parts per billion $K_2IrCl_6$ incorporated as grain surface modifier.
[4]The reciprocal of the relative amount of light in LogEx100 to produce 1.0 density.
[5]Slope of a line tangent to the sensitometric curve at the speed point.
[6]The density value of the point 0.3 LogE fast of the speed point.

Relative to Emulsion 17, inventive Emulsion 24 showed an improvement in Gamma and Shoulder Density over Emulsions 18–23, where individual compounds or specific combinations of compounds were utilized.

EXAMPLE 4

Emulsions 25 and 26 were prepared exactly as Emulsions 1 and 2, respectively.

Emulsion 27 was prepared and sensitized exactly as Emulsion 1 except that 0.075 moles of Emulsion L-5 and 0.225 mmoles of Emulsion L-1 were added during the Emulsion 32 was prepared and sensitized exactly as Emulsion 1 except that 0.06 mmoles of Emulsion L-2, 0.075 mmoles of Emulsion L-5, 0.015 mmoles of Emulsion L-7, and 0.15 mmoles of Emulsion L-1 were added during the sensitization process instead of 0.3 mmoles of Emulsion L-1. Thus, $3.0\times10^{-9}$ moles of $Os(NO)Cl_5$ per mole silver, $7.9\times10^{-6}$ moles of $Ru(CN)_6$ per mole silver chloride, and $7.0\times10^{-9}$ moles of $K_2IrCl_6$ per mole silver chloride were each added to Emulsion 32 as a grain surface modifier.

Example 4

| Emulsion | Grain Surface Modifier $Os(NO)Cl_5$[1] | $Ru(CN)_6$[2] | Ir[3] | Speed[4] | Gamma[5] | Percent Gamma Change | Shoulder Density[6] | Percent Shoulder Change |
|---|---|---|---|---|---|---|---|---|
| 25 | — | — | — | 139 | 2.11 | — | 1.75 | — |
| 26 | 3.0 | — | — | 126 | 2.95 | +40 | 1.91 | +9 |
| 27 | — | 7.9 | — | 159 | 2.18 | +3 | 1.71 | −2 |
| 28 | — | — | 7.0 | 154 | 1.58 | −25 | 1.53 | −13 |
| 29 | — | 7.9 | 7.0 | 163 | 1.94 | −8 | 1.62 | −7 |
| 30 | 3.0 | — | 7.0 | 129 | 2.42 | +15 | 1.79 | +2 |
| 31 | 3.0 | 7.9 | — | 134 | 3.30 | +56 | 1.97 | +13 |
| 32 | 3.0 | 7.9 | 7.0 | 139 | 3.03 | +43 | 1.87 | +7 |

[1]Mole parts per billion $Os(NO)Cl_5$/mole AgCl (TMC-21)
[2]Mole parts per million $Ru(CN)_6$/mole AgCl (TMC-78)
[3]Mole parts per billion $K_2IrCl_6$ incorporated as grain surface modifier
[4]The reciprocal of the relative amount of light in LogEx100 to produce 1.0 density.
[5]Slope of a line tangent to the sensitometric curve at the speed point.
[6]The density value of the point 0.3 LogE fast of the speed point.

Relative to Emulsion 25, inventive Emulsion 32 showed an improvement in Gamma and Shoulder Density over Emulsions 26–31, where individual compounds or specific combinations of compounds were utilized.

EXAMPLE 5

Emulsions 33, 34, 35 and 39 were prepared exactly as Emulsions 1, 2, 27 and 31, respectively.

Emulsions 36, 37, 38 and 40 were prepared exactly as Emulsions 28, 29, 30 and 32, respectively, except that the amount of $K_2IrCl_6$ was increased to $28.0\times10^{-9}$ moles per mole silver. This was accomplished by increasing the amount of Emulsion L-7 added during the sensitization to 0.06 mmoles and decreasing the amount of Emulsion L-1 by 0.045 mmoles.

Example 5

| Emulsion | Grain Surface Modifier $Os(NO)Cl_5$[1] | $Ru(CN)_6$[2] | Ir[3] | Speed[4] | Gamma[5] | Percent Gamma Change | Shoulder Density[6] | Percent Shoulder Change |
|---|---|---|---|---|---|---|---|---|
| 33 | — | — | — | 139 | 2.11 | — | 1.75 | — |
| 34 | 3.0 | — | — | 126 | 2.95 | +40 | 1.91 | +9 |
| 35 | — | 7.9 | — | 159 | 2.18 | +3 | 1.71 | −2 |
| 36 | — | — | 28.0 | 169 | 2.95 | +40 | 1.77 | +1 |
| 37 | — | 7.9 | 28.0 | 175 | 2.88 | +36 | 1.75 | 0 |
| 38 | 3.0 | — | 28.0 | 139 | 3.88 | +84 | 1.93 | +10 |
| 39 | 3.0 | 7.9 | — | 134 | 3.30 | +56 | 1.97 | +13 |
| 40 | 3.0 | 7.9 | 28.0 | 145 | 4.48 | +112 | 2.03 | +16 |

[1]Mole parts per billion $Os(NO)Cl_5$/mole AgCl (TMC-21)
[2]Mole parts per million $Ru(CN)_6$/mole AgCl (TMC-78)
[3]Mole parts per billion $K_2IrCl_6$ incorporated as grain surface modifier
[4]The reciprocal of the relative amount of light in LogEx100 to produce 1.0 density.
[5]Slope of a line tangent to the sensitometric curve at the speed point.
[6]The density value of the point 0.3 LogE fast of the speed point.

Relative to Emulsion 33, inventive Emulsion 40 showed an improvement in Gamma and Shoulder Density over Emulsions 34–39, where individual compounds or specific combinations of compounds were utilized.

EXAMPLE 6

Emulsions 41, 42, 44 and 46 were prepared exactly as Emulsions 1, 2, 20 and 22, respectively.

Emulsions 43, 45, 47 and 48 were prepared by the same procedures used in preparing Emulsions 19, 21, 23 and 24, respectively, except that by the use of Emulsion L-6 instead of Emulsion L-4, $7.9\times10^{-6}$ moles $Os(CN)_6$ per mole silver chloride were added as a grain surface modifier instead of $Fe(CN)_6$.

Example 6

| Emulsion | Grain Surface Modifier $Os(NO)Cl_5$[1] | $Os(CN)_6$[2] | Ir[3] | Speed[4] | Gamma[5] | Percent Gamma Change | Toe Density[6] | Percent Toe Change |
|---|---|---|---|---|---|---|---|---|
| 41 | — | — | — | 131 | 2.39 | — | 0.47 | — |
| 42 | 3.0 | — | — | 122 | 2.91 | +22 | 0.35 | −25 |
| 43 | — | 7.9 | — | 157 | 2.16 | −10 | 0.46 | −2 |
| 44 | — | — | 14.0 | 155 | 1.77 | −26 | 0.44 | −7 |
| 45 | — | 7.9 | 14.0 | 162 | 2.30 | −4 | 0.38 | −20 |
| 46 | 3.0 | — | 14.0 | 138 | 2.76 | +15 | 0.28 | −41 |
| 47 | 3.0 | 7.9 | — | 149 | 3.32 | +39 | 0.25 | −47 |
| 48 | 3.0 | 7.9 | 14.0 | 155 | 3.87 | +62 | 0.19 | −60 |

[1]Mole parts per billion $Os(NO)Cl_5$/mole AgCl (TMC-21)
[2]Mole parts per million $Os(CN)_6$/mole AgCl (TMC-79)
[3]Mole parts per billion $K_2IrCl_6$ incorporated as grain surface modifier
[4]The reciprocal of the relative amount of light in LogEx100 to produce 1.0 density.
[5]Slope of a line tangent to the sensitometric curve at the speed point.
[6]The density value of the point 0.3 LogE fast of the speed point.

Relative to Emulsion 41, inventive Emulsion 48 showed an improvement in Gamma and Toe Density over Emulsions 42–47, where individual compounds or specific combinations of compounds were utilized.

EXAMPLE 7

Emulsions 49, 51, 52 and 53 were prepared exactly as Emulsions 1, 19, 20 and 21, respectively.

Emulsions 50, 54, 55 and 56 were prepared by the same procedures used in preparing Emulsions 18, 22, 23 and 24, respectively, except that by the use of Emulsion L-3 instead of Emulsion L-2, $3.0\times10^{-9}$ moles $Os(NS)Cl_5$ per mole silver chloride were added as a grain surface modifier instead of $Os(NO)Cl_5$.

Example 7

| Emulsion | Grain Surface Modifier $Os(NS)Cl_5$[1] | $Fe(CN)_6$[2] | Ir[3] | Speed[4] | Gamma[5] | Percent Gamma Change | Toe Density[6] | Percent Toe Change |
|---|---|---|---|---|---|---|---|---|
| 49 | — | — | — | 131 | 2.39 | — | 0.47 | — |
| 50 | 3.0 | — | — | 119 | 2.94 | +22 | 0.38 | −18 |
| 51 | — | 7.9 | — | 149 | 2.30 | −4 | 0.43 | −8 |
| 52 | — | — | 14.0 | 155 | 1.77 | −26 | 0.44 | −7 |
| 53 | — | 7.9 | 14.0 | 167 | 2.70 | +13 | 0.34 | −28 |
| 54 | 3.0 | — | 14.0 | 133 | 2.17 | −9 | 0.35 | −26 |
| 55 | 3.0 | 7.9 | — | 136 | 3.14 | +31 | 0.29 | −38 |
| 56 | 3.0 | 7.9 | 14.0 | 142 | 3.45 | +44 | 0.23 | −51 |

[1]Mole parts per billion $Os(NS)Cl_5$/mole AgCl (TMC-27)
[2]Mole parts per million $Fe(CN)_6$/mole AgCl (TMC-80)
[3]Mole parts per billion $K_2IrCl_6$ incorporated as grain surface modifier
[4]The reciprocal of the relative amount of light in LogEx100 to produce 1.0 density.
[5]Slope of a line tangent to the sensitometric curve at the speed point.
[6]The density value of the point 0.3 LogE fast of the speed point.

Relative to Emulsion 49, inventive Emulsion 56 showed an improvement in Gamma and Toe Density over Emulsions 50–55, where individual compounds or specific combinations of compounds were utilized.

The invention has been described in detail with particular reference to preferred embodiments thereof but it will be understood that variations and modifications can be effected within the spirit and scope of the invention.

What is claimed is:

1. A photographic silver halide emulsion comprising silver halide grains having incorporated therein a first and second grain surface modifier, and a hexacoordination complex comprising iridium, wherein the first grain surface modifier has the structure:

$$[TE_4(NZ)E']^r$$

where

T is a transition metal selected from the Groups 5 to 10, inclusive, of the periodic table;

Z is oxygen or sulfur, and together with nitrogen forms the nitrosyl or thionitrosyl ligand;

E and E' represent ligands; and r is zero, −1, −2, or −3; the second grain surface modifier has the structure:

$$[M(CN)_{6-y}L_y]^n$$

where

M is a Group 7 to 10 transition metal other than iridium;

L is a ligand;

y is zero, 1, 2, or 3; and n is zero, −1, −2, −3, or −4; and the hexacoordination complex comprising iridium has the structure:

$$R_qIrX_6$$

where

R represents a hydrogen atom, an alkali metal atom, or an ammonium radical;

q is 2, 3; or 4; and

X represents a ligand.

2. A photographic emulsion according to claim 1 wherein the first grain surface modifier comprises a transition metal selected from Group 8 of the periodic table.

3. A photographic emulsion according to claim 2 wherein said silver halide grains contain silver chloride and are substantially free of silver bromide or silver iodide.

4. A photographic emulsion according to claim 2 wherein said first grain surface modifier is $[Os(NO)Cl_5]^{-2}$.

5. A photographic emulsion according to claim 4 wherein $[Os(NO)Cl_5]^{-2}$ is in an amount between about $7.5\times10^{-10}$ and about $3.0\times10^{-8}$ moles per mole of silver chloride.

6. A photographic emulsion according to claim 5 wherein $[Os(NO)Cl_5]^{-2}$ is in an amount between about $1.0\times10^{-9}$ and about $2.0\times10^{-8}$ moles per mole of silver chloride.

7. A photographic emulsion according to claim 6 wherein $[Os(NO)Cl_5]^{-2}$ is in an amount between about $3.0\times10^{-9}$ and about $1.8\times10^{-8}$ moles per mole of silver chloride.

8. A photographic emulsion according to claim 1 wherein the second grain surface modifier comprises a transition metal selected from Group 8 of the periodic table.

9. A photographic emulsion according to claim 8 wherein said second grain surface modifier is in the form of $[Fe(CN)_6]^{-4}$.

10. A photographic emulsion according to claim 9 comprising $[Fe(CN)_6]^{-4}$ in an amount between about $1.0\times10^{-6}$ and about $5.0\times10^{-4}$ moles per mole of silver chloride.

11. A photographic emulsion according to claim 10 comprising $[Fe(CN)_6]^{-4}$ in an amount between about $1.0\times10^{-6}$ and about $4.0\times10^{-5}$ moles per mole of silver chloride.

12. A photographic emulsion according to claim 11 comprising $[Fe(CN)_6]^{-4}$ in an amount between about $3.9\times10^{-6}$ and about $3.2\times10^{-5}$ moles per mole of silver chloride.

13. A photographic emulsion according to claim 8 wherein said second grain surface modifier is in the form of $[Ru(CN)_6]^{-4}$.

14. A photographic emulsion according to claim 13 comprising $[Ru(CN)_6]^{-4}$ in an amount between about $1.0\times10^{-6}$ and about $5.0\times10^{-4}$ moles per mole of silver chloride.

15. A photographic emulsion according to claim 14 comprising $[Ru(CN)_6]^{-4}$ in an amount between about $1.0\times10^{-6}$ and about $4.0\times10^{-5}$ moles per mole of silver chloride.

16. A photographic emulsion according to claim 15 comprising $[Ru(CN)_6]^{-4}$ in an amount between about $3.9\times10^{-6}$ and about $3.2\times10^{-5}$ moles per mole of silver chloride.

17. A photographic emulsion according to claim 1 wherein X represents a halogen atom.

18. A photographic emulsion according to claim 1 wherein the hexacoordination complex comprising iridium is a dopant.

19. A photographic emulsion according to claim 18 wherein said dopant is incorporated throughout 90 to 95 percent of the volume of said silver halide grains.

20. A photographic emulsion according to claim 1 wherein the hexacoordination complex comprising iridium is a grain surface modifier.

21. A photographic emulsion according to claim 20 wherein the grain surface modifiers are positioned at intervals along the surface of said silver halide grains in a silver halide carrier, said silver halide carrier accounting for less than about two mole percent of said silver halide grain.

22. A photographic emulsion according to claim 21 wherein said silver halide carrier accounts for less than about one mole percent of said silver halide grains.

23. A photographic silver halide emulsion comprising an iridium containing transition metal complex and silver halide grains modified subsequent to their formation by at least two different grain surface modifiers, the first of which having the structure:

$$[TE_4(NZ)E']^r$$

where

T is a transition metal selected from Group 8 of the periodic table;

Z is oxygen or sulfur, and together with nitrogen forms the nitrosyl or thionitrosyl ligand;

E and E' represent ligands; and r is 0, −1, −2, or −3; and the second of which having the structure:

$$[M(CN)_{6-y}L_y]^n$$

wherein

M is a Group 8 transition metal;

L is a ligand;

y is 0, 1, 2, or 3; and n is 0, −1, −2, −3, or −4; and wherein the iridium containing transition metal complex has the structure:

$$R_gIrX_6$$

wherein

R represents a hydrogen atom, an alkali metal atom, or an ammonium radical;

g is 2, 3 or 4; and

X represents a ligand.

* * * * *